US006821060B2

(12) United States Patent
McTurk et al.

(10) Patent No.: US 6,821,060 B2
(45) Date of Patent: Nov. 23, 2004

(54) JET PUMP SYSTEM FOR FORMING AN AQUEOUS OIL SAND SLURRY

(75) Inventors: Jim McTurk, Fort McMurray (CA); Ron Cleminson, Fort McMurray (CA); Andrew Rosser, Fort McMurray (CA)

(73) Assignees: ACE Oil Sands, L.P., Calgary (CA); Canadian Oil Sands Commerical Trust, Calgary (CA); Canadian Oil Sands Limited, Calgary (CA); ConocoPhillips Oilsands Partnership II, Calgary (CA); Imperial Oil Resources, Calgary (CA); Mocal Energy Limited, Tokyo (JP); Murphy Oil Company, Ltd., Calgary (JP); Nexen Inc., Calgary (CA); Petro-Canada Oil and Gas, Calgary (CA)

( * ) Notice: Subject to any disclaimer, the term of this patent is extended or adjusted under 35 U.S.C. 154(b) by 0 days.

(21) Appl. No.: 10/371,156

(22) Filed: Feb. 24, 2003

(65) Prior Publication Data

US 2004/0165960 A1 Aug. 26, 2004

(51) Int. Cl.[7] ..... B65G 53/38

(52) U.S. Cl. ..... 406/137; 406/106; 406/141; 406/144; 406/146; 241/160; 241/18

(58) Field of Search ..... 406/92, 106, 137, 406/141, 144, 146; 241/160, 18

(56) References Cited

U.S. PATENT DOCUMENTS

| | | | | | |
|---|---|---|---|---|---|
| 3,674,216 | A | * | 7/1972 | Blair | 241/18 |
| 3,925,189 | A | * | 12/1975 | Wicks, III | 208/390 |
| 4,032,193 | A | * | 6/1977 | Drinkard et al. | 299/4 |
| 4,286,935 | A | * | 9/1981 | Okuno et al. | 425/72.1 |
| 4,451,184 | A | * | 5/1984 | Mitchell | 406/105 |
| 4,944,347 | A | * | 7/1990 | Richard et al. | 166/278 |
| 5,012,984 | A | * | 5/1991 | Ishikawa et al. | 241/16 |
| 5,039,227 | A | * | 8/1991 | Leung et al. | 366/137 |
| 5,421,524 | A | * | 6/1995 | Haddow | 241/5 |
| 5,772,127 | A | * | 6/1998 | Maciejewski et al. | 241/21 |
| 5,954,277 | A | * | 9/1999 | Maciejewski et al. | 241/21 |
| 6,027,056 | A | * | 2/2000 | Maciejewski et al. | 241/62 |
| 6,076,753 | A | * | 6/2000 | Maciejewski et al. | 241/62 |
| 6,368,029 | B1 | * | 4/2002 | d'Aquin | 406/197 |
| 6,467,707 | B1 | * | 10/2002 | Williams, Jr. | 241/18 |

* cited by examiner

*Primary Examiner*—Joe Dillon, Jr.
(74) *Attorney, Agent, or Firm*—Millen, White, Zelano & Branigan, P.C.

(57) ABSTRACT

As-mined oil sand is crushed to −5 inch by a sequentially arranged pair of double roll crushers. The crushed oil sand is fed into a hopper feeding a jet pump. Water or recycled slurry is fed under pressure as motive fluid to the jet pump. The motive fluid jet(s) produced internally by the jet pump are operative to fluidize the oil sand and the components of the slurry mix turbulently in the jet pump's tubular mixer. It is found that the slurry issuing from the jet pump is aerated and largely free of lumps.

4 Claims, 5 Drawing Sheets

JET PUMP SYSTEM FOR FORMING AN AQUEOUS OIL SAND SLURRY

FIELD OF THE INVENTION

The present invention relates to a process and apparatus for mixing oil sand with water and air to produce a slurry suitable for pumping and pipelining.

BACKGROUND OF THE INVENTION

The surface-minable oil sands in the Fort McMurray region of Northern Alberta have now been commercially exploited for about 30 years.

Initially, the as-mined oil sand was deposited on conveyor belts and transported to a facility known as an extraction plant. Here the oil sand was crushed, screened to remove oversize and then introduced into a large, horizontal, rotating drum (referred to as a 'tumbler'), together with hot water (95° C.), a process aid (NaOH) and steam. The tumbler had internal lifters which would lift and cascade the mixture as it advanced lengthwise through the tumbler chamber. A thick hot slurry containing entrained air bubbles would be formed.

During residence in the tumbler:

- lumps of oil sand would be fragmented and would disintegrate;
- a bitumen would separate from the sand and enter the water phase of the slurry as small flecks; and
- some bitumen flecks would coalesce and attach to air bubbles.

The sum of these actions is referred to in the industry as 'conditioning'.

The resulting conditioned slurry would then be diluted with additional hot water and would be introduced into a large, open-topped, cylindrical flotation vessel having a conical bottom. This vessel is known as the primary separation vessel or 'PSV'. In the PSV, the sand would settle under the influence of gravity, be concentrated in the cone and leave as an underflow stream of wet tailings. The aerated bitumen would rise and be recovered as an overflow stream of froth. A watery mixture called 'middlings' would be withdrawn from the mid-section of the PSV and would be further processed to recover residual bitumen.

As the mining areas got further from the extraction plant, a new system was implemented. The as-mined oil sand was crushed and mixed with hot water at the mine site. The produced slurry, containing entrained air, was then pumped through a pipeline. It had been discovered that the slurry would 'condition' suitably, if given adequate retention time, as it moved through the pipeline. It could then be fed directly to the PSV. The degree of bitumen recovery in the PSV was found to be sufficient to be viable.

In connection with this new 'at the mine site' system, it was necessary to develop means for forming a pumpable, pipelineable slurry from the dry as-mined oil sand, which comprises large frozen lumps, rocks and the like.

At applicants' facility, two distinct slurry preparation systems were sequentially developed and installed on a commercial basis.

The first slurry preparation system was disclosed in our U.S. Pat. No. 5,039,227. This system involved a vertical tower arrangement comprising:

- an open-topped cylindrical vessel (called a 'cyclofeeder'), having a conical bottom and central bottom outlet, for forming slurry;
- a set of vibrating screens which were positioned beneath the bottom outlet and which were adapted to reject +2 inch material from the slurry;

- a tall pump box positioned beneath the screens for receiving the screened slurry; and
- a pump for pumping slurry from the pump box into a pipeline.

The as-mined oil sand would first be crushed to −24 inches. The crushed oil sand and added water would then be poured into the cyclofeeder chamber, where they would add to a rotating vortex of slurry recycled from the pump box and pumped tangentially into the vessel chamber. Air would be entrained in the vortex. The resulting slurry dropped onto the screens. The rejected oversize material was dumped on the ground or was conveyed to another crusher and subjected to a repetition of the same process. The wet-screened slurry was collected in the pump box, ready for pumping down the pipeline, and a portion was pumped back to the cyclofeeder to form the vortex.

The second slurry preparation system was disclosed in our U.S. Pat. No. 5,772,127. It too was a vertical tower arrangement it involved:

- a downwardly descending zig-zag arrangement of troughs into which oil sand and water would be poured, to mix and form a slurry containing entrained air;
- a set of screens for separating +4 inch oversize from the slurry;
- an impactor for breaking up some of the screen reject material;
- a screen for screening the impactor product to produce oversize rejects and underflow;
- a tall pump box positioned to receive the wet-screened slurry and the impactor underflow; and
- a pump for pumping slurry from the pump box into a pipeline.

The as-mined oil sand was crushed to −24 inches. The crushed oil sand and water were fed into the trough, where they mixed and formed the slurry. Air would concurrently be entrained in the slurry. The slurry was wet-screened to reject +4 inch material. The screen reject was impacted and then screened. The impactor product was directed into the pump box. The impactor reject was dumped onto the ground.

The second slurry preparation system was better than the first in that the amount of reject (and the oil lost with it) was significantly reduced.

The two slurry preparation systems had certain problematic characteristics, namely:

- they were massive and essentially non-movable (the first system was 34 meters tall, the second was 32 meters tall):
- they both dumped rejects on the ground—these rejects had to be continually removed with loaders and trucks, to make room for new reject material and to suitably dispose of the removed material; and
- due to their immobility, the system could not follow the mining shovels and therefore the cost of trucking the as-mined oil sand from the shovel to the slurry preparation tower increased steadily as the shovels moved further away.

There has therefore existed a long-standing need to provide a re-locatable, smaller, lighter, simpler slurry preparation system. It is the objective of this invention to provide such a system.

SUMMARY OF THE INVENTION

In accordance with the invention, as-mined oil sand is first crushed to a pumpable size. This is preferably done using a sequentially arranged pair of double roll crushers operative to crush the as-mined oil sand in stages, to a final size of about −5 inches or less. The entire stream of pre-crushed oil sand is then fed into a mass flow hopper. The hopper is connected to a conventional jet pump and feeds the oil sand into its fluidization chamber.

The jet pump comprises:

a body forming the fluidization chamber;

a main nozzle, connected to a source of pressurized motive fluid, the nozzle being operative to deliver a jet of fluid from one end of the fluidization chamber;

a tubular mixer, aligned in spaced downstream relationship to the main nozzle, so as to receive the jet into its inlet end, the mixer extending through the other end of the body;

optionally, one or more dilution nozzles, also connected to a source of pressurized motive fluid, are positioned in the fluidization chamber. The dilution nozzles are operative to inject jets of motive fluid to assist in fluidizing oil sand entering the chamber from the hopper; and a slurry line, connected to the outlet end of the mixer, for conveying away produced slurry.

In operation, the motive fluid jet from the main nozzle extends through the open space in the fluidization chamber, between it and the mixer, and enters the bore of the mixer. In the course of doing so, it entrains oil sand entering from the hopper. The dilution nozzles emit fluid jets which help to fluidize the oil sand entering the chamber. The motive fluid and oil sand mix as they move through the bore of the mixer. Lumps are disintegrated. Entrained air contacts and aerates bitumen. These actions continue in the downstream slurry line.

Surprisingly, our testing indicates that the lumps of oil sand have been largely or entirely disintegrated by the time the product slurry leaves the jet pump. We believe that the combination of acceleration, shear, mixing and heat inputs cause this remarkable and almost instantaneous disintegration. The jet pump produces a slurry that can be directly fed into and pumped through the downstream slurry line.

Furthermore, our testing indicates that the slurry leaving the jet pump is well advanced to being fully conditioned. Instead of having to pump the slurry for 10–15 minutes through several kilometers of pipeline to condition it sufficiently to feed it to a PSV, it appears that the jet pump slurry is fully conditioned in less than a minute of pipeline travel.

Should a higher density slurry be desirable, a screened slipstream can be withdrawn from the slurry line and introduced into the fluid going to the jet pump main nozzle. Our testing has indicated that denser fluid going to the nozzle increases oil sand capture, producing a dense slurry (e.g. 1.6 S.G.), The system is also characterized by the following additional advantages:

the size and weight of the present slurry preparation system is only a fraction of the prior art towers. It is feasible to periodically relocate the hopper and jet pump assembly to keep it near to the mine face;

a there are no rejects from the system and consequently no oil losses with rejects; and there is no need for slurry screens.

In one embodiment, a process is provided for preparing an aerated aqueous oil sand slurry comprising: crushing as-mined oil sand to pumpable size; feeding the crushed oil sand to a jet pump; supplying motive fluid under pressure to the jet pump to form a fluid jet which entrains and mixes with the oil sand and forms an aerated slurry; and discharging the slurry into a downstream product line.

In another embodiment, an apparatus is provided for preparing an aqueous aerated oil sand slurry from as-mined oil sand, comprising: crusher means for crushing the as-mined oil sand to pumpable size; a hopper; means for feeding the crushed oil sand into the hopper; a jet pump comprising a body forming a fluidization chamber, a main nozzle extending into the fluidization chamber and a tubular mixer spaced downstream from the main nozzle and extending out of the body; the hopper being connected to the jet pump body so as to feed oil sand into the fluidization chamber; means for supplying motive fluid under pressure to the main nozzle to form a fluid jet which entrains and mixes with the oil sand to form an aerated aqueous oil sand slurry; and conduit means connected to the downstream end of the mixer for conveying the slurry produced by the jet pump.

DESCRIPTION OF THE PREFERRED EMBODIMENT

Figure 1:
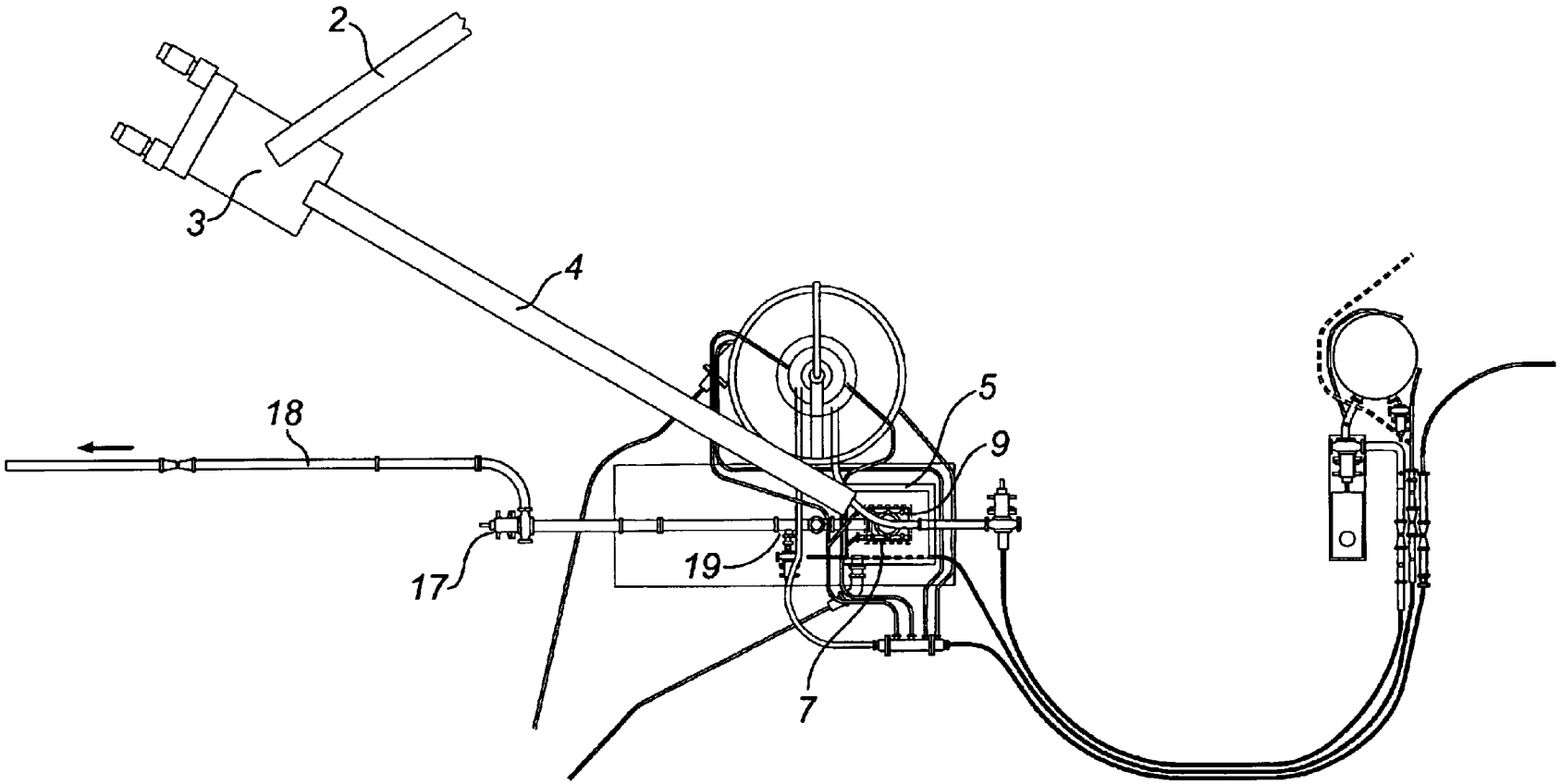
FIG. 1 is a plan view showing a test pilot slurry preparation system in accordance with the invention.
Figure 2:
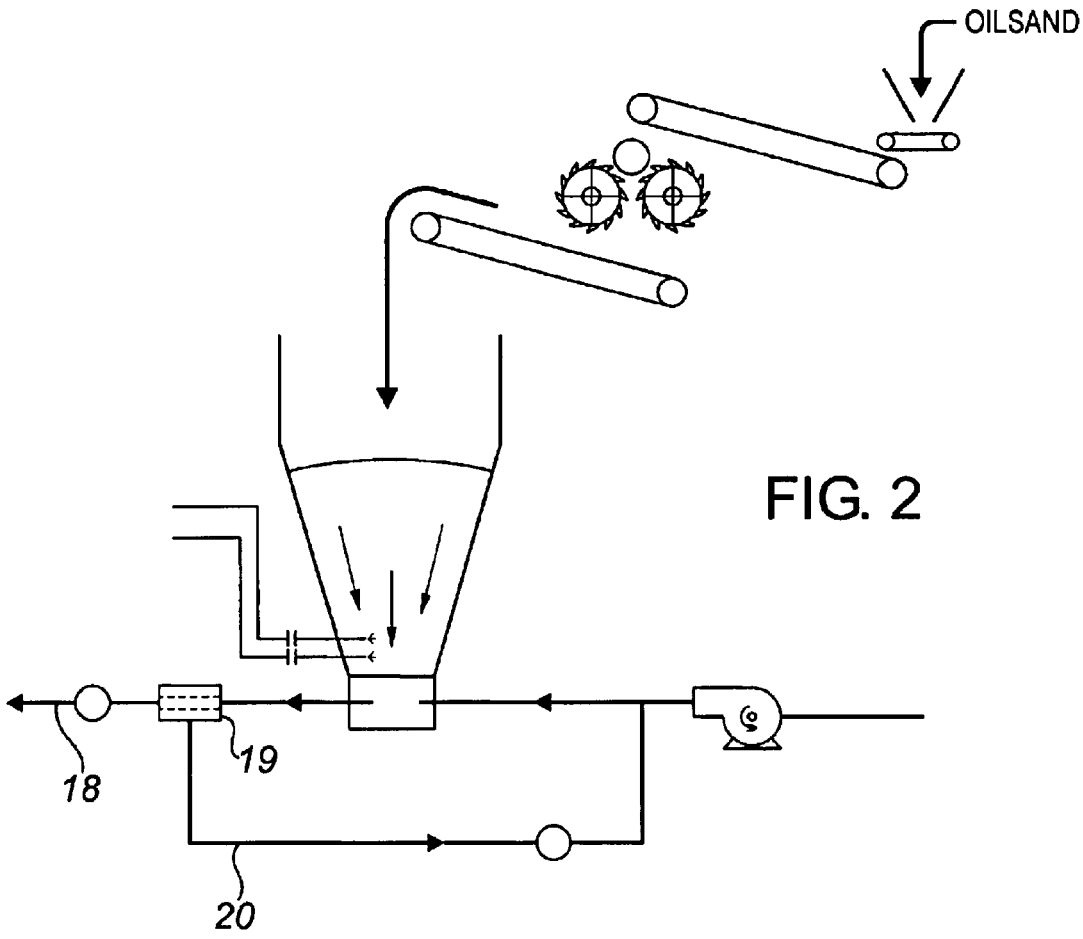
FIG. 2 is a simplified schematic representation of the slurry preparation system of FIG. 1.
Figure 3:
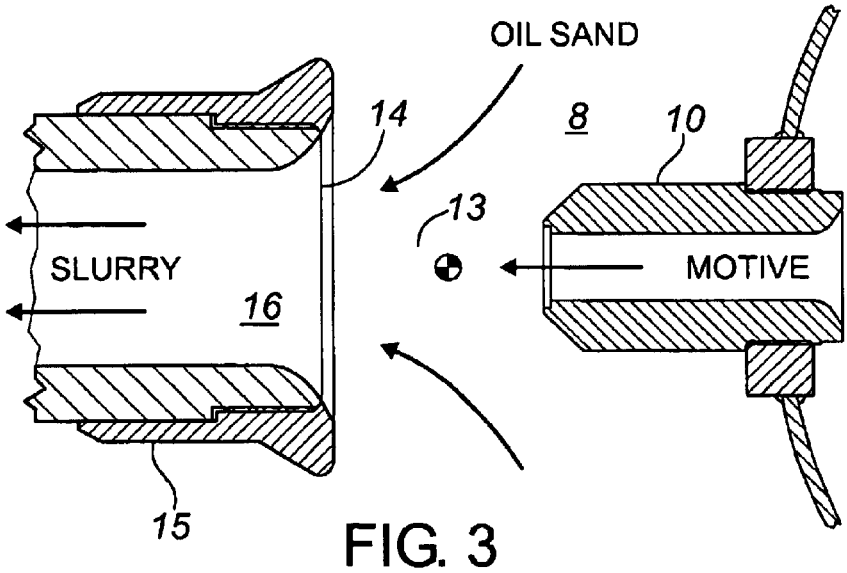
FIG. 3 is a sectional side view showing the main nozzle and inlet to the mixer, with arrows indicating the paths of oil sand and motive fluid.
Figure 4:
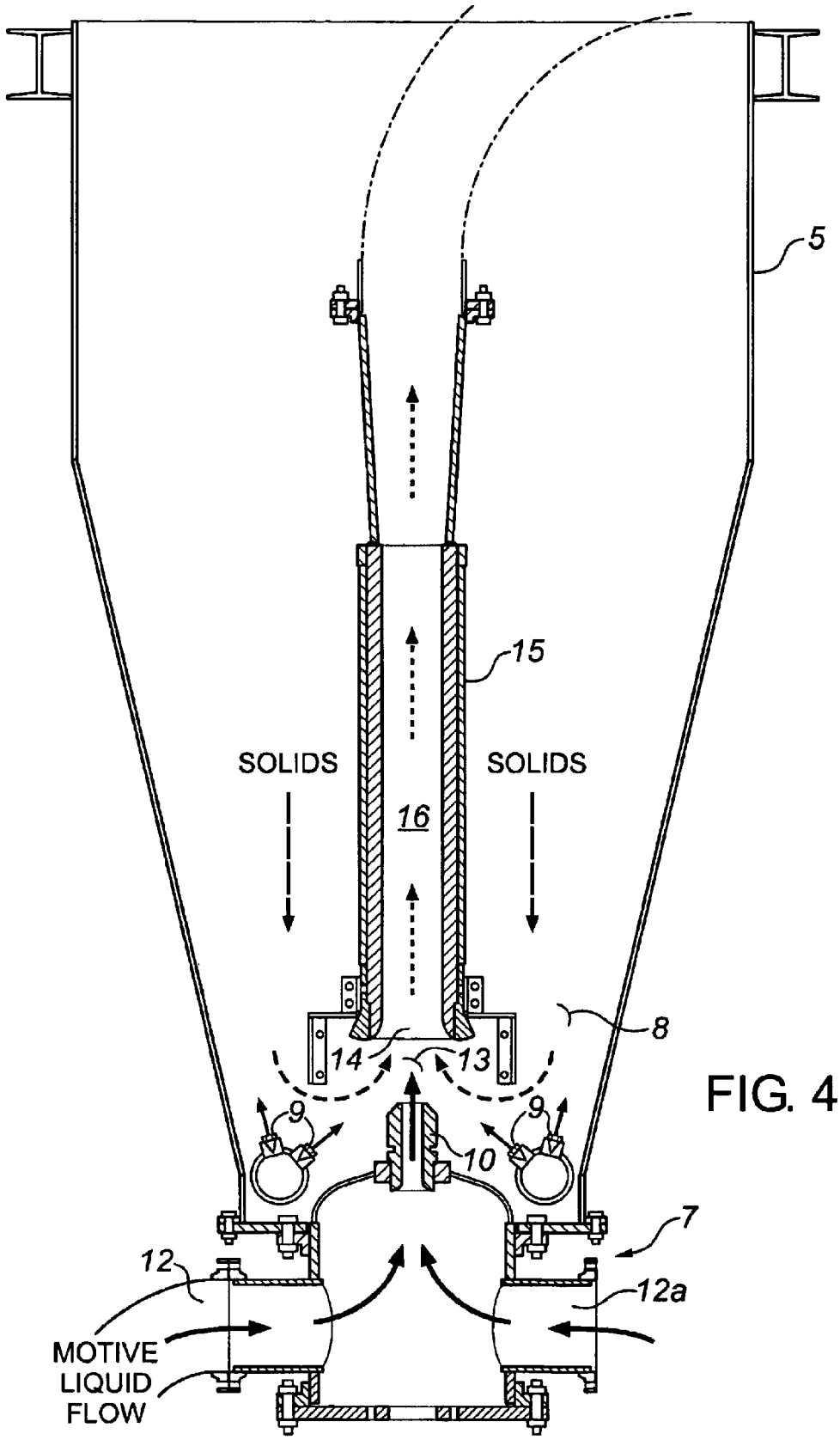
FIG. 4 is a plan view in section of a known jet pump.
Figure 6:
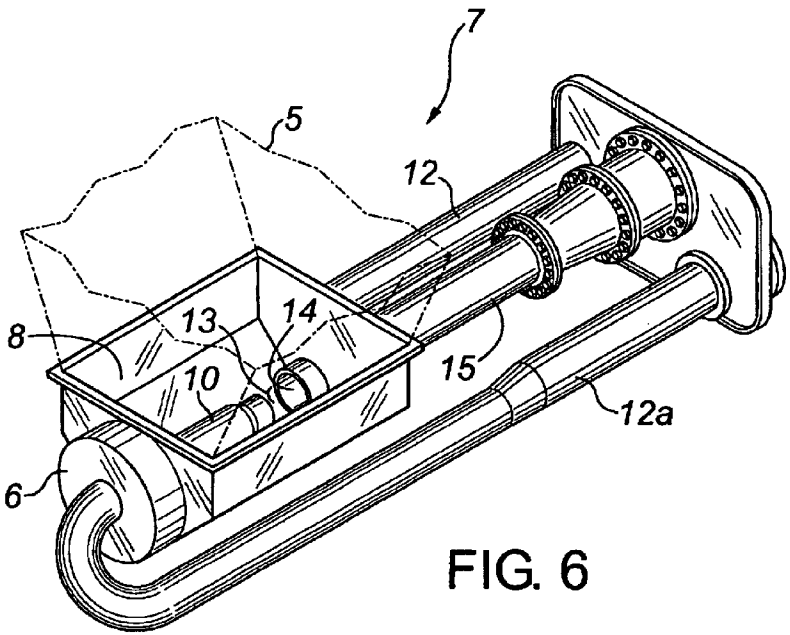
FIGS. 5 and 6 are perspective views of a jet pump connected to a mass flow hopper.
Figure 5:
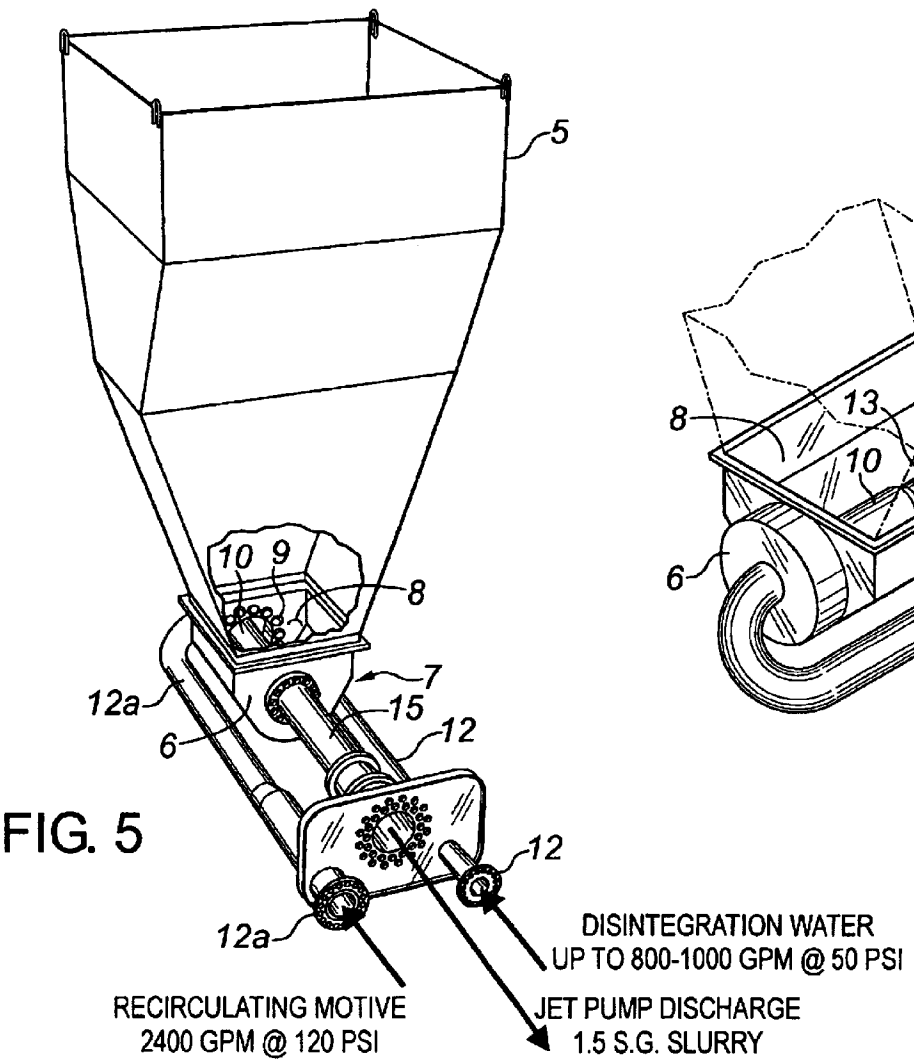
Figure 7:
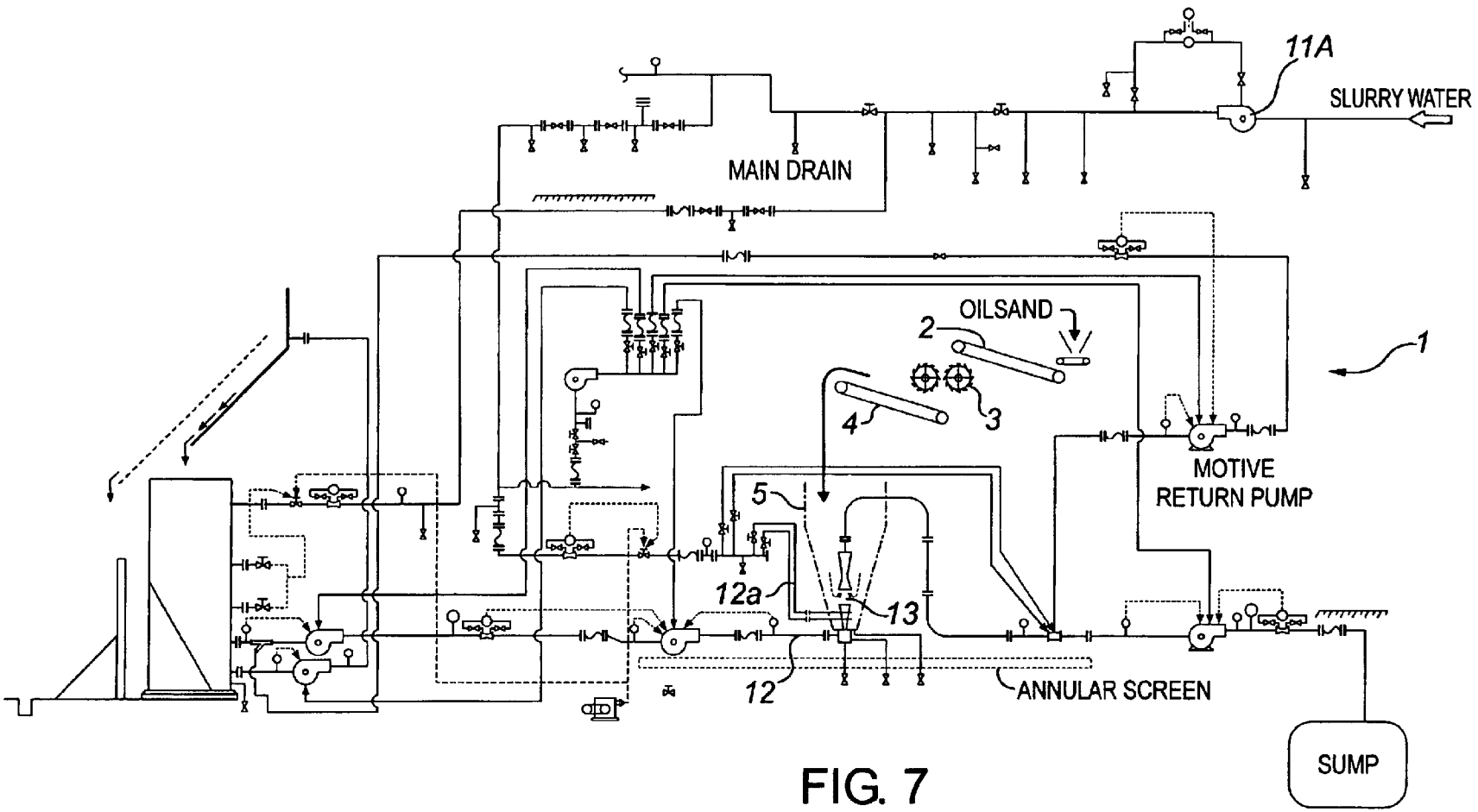
FIG. 7 is a schematic of the slurry preparation system of FIG. 1.

The invention will be described with respect to the slurry preparation test pilot system 1 shown in FIGS. 1 and 7.

The test pilot system 1 comprised a conveyor 2 which fed −12 inch pre-crushed oil sand to a double roll ABON™ crusher 3, which crushed it to −3 inch. The crushed oil sand was then fed by a second conveyor 4 to a mass flow hopper 5.

The hopper 5 was mounted to the body 6 of a top-loading GENFLO™ jet pump 7. Oil sand flowed by gravity into the fluidization chamber 8 of the jet pump 7. Dilution nozzles 9 injected water under pressure in the form of jets into the chamber 8, to fluidize and mix with the oil sand. Water (or, in some runs, recycled slurry) was supplied under pressure to main nozzle 10 and dilution nozzles 9 by pumps 11, 11*a* through motive fluid supply lines 12, 12*a*. The motive water left the main nozzle 10 in the form of a powerful jet. The water jet crossed on entrainment zone 12 in the fluidization chamber 8 and entered the inlet 14 of the bore 16 of a coaxial tubular mixer 15. The jet induced the oil sand and water mixture in chamber 8 to be drawn into the bore 16. The water and oil sand formed an aqueous slurry which mixed turbulently as it proceeded through the bore 16. The slurry contained entrained air. The mixer 15 was connected at its outlet end with a downstream pump 17 and product line 18. An inline screen 19 and recycle line 20 were connected between the product line 18 and the fluid supply line 12. If desired, a fine solids slurry could be recycled to the main nozzle 10 to increase fluid density in the product line 18.

The following data and results characterized two typical runs of the pilot.

| Data Line # | 12976 | 15169 |
|---|---|---|
| Dilution Water flowrate l/s | 14.58 | 15.23 |
| Process Water flowrate l/s | 61.5 | 79.5 |
| Density in Slurry product line t/m3 | 1.41 | 1.60 |
| Density in motive fluid line t/m3 | 1.0 | 1.39 |
| Main nozzle pressure kpa | 849.4 | 974.8 |
| Jet pump discharge pressure kpa | 126.0 | 115.6 |
| Process Water temperature deg C | 43 | 57.4 |

Although a preferred embodiment has been shown and described, it will be appreciated by those skilled in the art that various changes and modifications might be made without departing from the scope of the invention, as defined in the appended claims.

The preceding examples can be repeated with similar success by substituting the generically or specifically described operating conditions of this invention for those used in the preceding examples.

The entire disclosure of all applications, patents and publications, cited herein is incorporated by reference herein.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for preparing an aerated aqueous oil sand slurry comprising:

crushing as-mined oil sand to pumpable size;

feeding the crushed oil sand to a jet pump;

supplying motive liquid under pressure to the jet pump to form a fluid jet which entrains and mixes with the oil sand and forms an aerated slurry; and discharging the slurry into a downstream product line.

2. The process as set forth in claim 1 comprising:

recycling part of the formed slurry back to the jet pump to control the density of the slurry.

3. The process as set forth in claim 1 wherein:

the as-mined oil sand is crushed to −5 inch.

4. The process as set forth in claim 1, wherein the motive fluid is water.

* * * * *

UNITED STATES PATENT AND TRADEMARK OFFICE

CERTIFICATE OF CORRECTION

PATENT NO. : 6,821,060 B2
APPLICATION NO. : 10/371156
DATED : November 23, 2004
INVENTOR(S) : Jim McTurk et al.

It is certified that error appears in the above-identified patent and that said Letters Patent is hereby corrected as shown below:

On the front page, Assignees: line 1, reads "ACE Oil Sands," should read -- AEC Oil Sands, --

Signed and Sealed this

Twenty-second Day of August, 2006

JON W. DUDAS
*Director of the United States Patent and Trademark Office*